US009329571B2

(12) United States Patent
Charbon et al.

(10) Patent No.: US 9,329,571 B2
(45) Date of Patent: May 3, 2016

(54) MAINSPRING FOR A TIMEPIECE

(71) Applicant: Nivarox-FAR S.A., Le Locle (CH)

(72) Inventors: Christian Charbon, Chezard-St-Martin (CH); Maxime Govaerts, Yverdon (CH); Pierre Cusin, Villars-Burquin (CH); Marco Verardo, Les Bois (CH)

(73) Assignee: Nivarox-FAR S.A., Le Locle (CH)

( * ) Notice: Subject to any disclaimer, the term of this patent is extended or adjusted under 35 U.S.C. 154(b) by 0 days.

(21) Appl. No.: 14/408,752

(22) PCT Filed: May 30, 2013

(86) PCT No.: PCT/EP2013/061168

§ 371 (c)(1),
(2) Date: Dec. 17, 2014

(87) PCT Pub. No.: WO2014/001017

PCT Pub. Date: Jan. 3, 2014

(65) Prior Publication Data

US 2015/0277380 A1 Oct. 1, 2015

(30) Foreign Application Priority Data

Jun. 28, 2012 (EP) ..... 12174129

(51) Int. Cl.
*G04B 1/14* (2006.01)
*G04B 1/18* (2006.01)

(52) U.S. Cl.
CPC *G04B 1/14* (2013.01); *G04B 1/145* (2013.01); *G04B 1/185* (2013.01)

(58) Field of Classification Search
CPC ..... G04B 1/10; G04B 1/14; G04B 1/145; G04B 1/18; G04B 1/20
See application file for complete search history.

(56) References Cited

U.S. PATENT DOCUMENTS

| | | | | | |
|---|---|---|---|---|---|
| 3,018,097 | A * | 1/1962 | Johansson | F03G 1/00 185/45 |
| 3,433,011 | A * | 3/1969 | Isekil | G04B 1/14 368/140 |
| 3,465,514 | A | 9/1969 | Haueter | |
| 3,465,515 | A * | 9/1969 | Jaquet | G04B 1/14 368/132 |
| 3,599,422 | A * | 8/1971 | Haueter | G04B 1/185 368/147 |
| 3,928,085 | A * | 12/1975 | Yamamura | G04B 1/145 148/419 |
| 2002/0191493 | A1* | 12/2002 | Hara | F16F 1/024 368/140 |
| 2007/0227893 | A1 | 10/2007 | Saucy | |
| 2009/0245030 | A1* | 10/2009 | Buhler | G04B 17/066 368/177 |
| 2011/0062112 | A1 | 3/2011 | Saucy | |
| 2011/0303546 | A1 | 12/2011 | Saucy | |

(Continued)

FOREIGN PATENT DOCUMENTS

| | | | |
|---|---|---|---|
| EP | 1 835 339 | A1 | 9/2007 |
| EP | 2 466 393 | A2 | 6/2012 |

(Continued)

OTHER PUBLICATIONS

English Translation of Haueter, FR2070714, originally published Sep. 17, 1971, electronically translated Aug. 27, 2015.*

(Continued)

*Primary Examiner* — Amy Cohen Johnson
*Assistant Examiner* — Matthew Powell
(74) *Attorney, Agent, or Firm* — Oblon, McClelland, Maier & Neustadt, L.L.P

(57) ABSTRACT

A mainspring including a metallic strip wound on itself. The mainspring includes an excess thickness forming a bridle in one-piece with the strip.

10 Claims, 2 Drawing Sheets

(56) References Cited

U.S. PATENT DOCUMENTS

| | | | | |
|---|---|---|---|---|
| 2012/0281510 | A1* | 11/2012 | Gyger | C22C 1/002 368/140 |
| 2013/0283615 | A1* | 10/2013 | Kaelin | G04B 1/16 29/896.31 |
| 2014/0003203 | A1* | 1/2014 | Charbon | G04B 1/145 368/140 |
| 2014/0160902 | A1* | 6/2014 | Cusin | G04B 13/022 368/140 |

FOREIGN PATENT DOCUMENTS

| | | | |
|---|---|---|---|
| FR | 1 552 454 | A | 1/1969 |
| FR | 2 070 714 | A1 | 9/1971 |

OTHER PUBLICATIONS

International Search Report issued Jul. 4, 2013 in PCT/EP2013/061168 Filed May 30, 2013.

* cited by examiner

MAINSPRING FOR A TIMEPIECE

CROSS-REFERENCE TO RELATED APPLICATIONS

This is a National phase application in the United States of International Patent Application PCT/EP2013/061168 filed May 30, 2013 which claims priority on European Patent application 12174129.2 of Jun. 28, 2012. The entire disclosure of each of the above patent applications are hereby incorporated by reference.

FIELD OF THE INVENTION

The invention relates to a mainspring for a timepiece and particularly a mainspring intended to be integrated in a barrel.

BACKGROUND OF THE INVENTION

It is known to weld a bridle to a mainspring or striking spring to limit the movement of the spring in its drum when it is let down. However, since springs, especially striking springs, are very small, it is difficult to manufacture such small bridles and to secure them to such small strips.

SUMMARY OF THE INVENTION

It is an object of the present invention to overcome all or part of the aforementioned drawbacks, by proposing a method of simplifying the manufacturing steps for mainsprings of small dimensions while significantly reducing the discard rate.

To this end, according to a first variant, the invention relates to a mainspring including a metallic strip wound on itself, characterized in that the mainspring includes an outer coil having an excess thickness between the start of the outer coil and before the free end of the outer coil which forms a bridle in a single piece with the strip.

It is thus understood that the problems caused by the small dimensions of the bridle are cancelled out by the one-piece construction. Further, the bridle is always perfectly positioned relative to the strip of the mainspring.

According to a second variant, the invention relates to a mainspring including a metallic strip wound on itself, characterized in that the mainspring includes an outer coil having an excess thickness in one-piece with the strip, between the start of the outer coil and before the free end of the outer coil, which forms a base and in that at least a second strip forming a bridle in one-piece with the strip extends from the excess thickness forming a base.

In accordance with other advantageous features of the invention:

- said at least one second strip is formed relative to the thickness and/or the height of the excess thickness;
- said at least one second strip has a constant thickness and/or a constant height;
- said at least one second strip has a non-constant thickness and/or a non-constant height;
- the excess thickness is formed with relative to the thickness and/or the height of the strip;
- the excess thickness includes a constant thickness and/or a constant height;
- the excess thickness has a non-constant thickness and/or a non-constant height;
- the mainspring includes an inner coil with an eyelet and/or a hook and/or a collet integral with the strip;
- the mainspring is formed from a nickel and phosphorus alloy base.

Moreover, the invention relates to a timepiece, characterized in that it includes a mainspring according to any of the preceding variants.

Finally, the invention relates to a method of manufacturing a mainspring including the following steps:

a) forming a mould on a substrate;

b) electroforming, in the mould, a metallic strip wound on itself and including an outer coil having an excess thickness between the start of the outer coil and before the free end of the outer coil which forms a bridle in one-piece with the strip;

c) releasing the strip from the mould and from the substrate in order to form a mainspring.

It is thus understood that there are no longer separate steps for manufacturing and securing the bridle to the mainspring. Indeed, the bridle is directly formed at the same time as the mainspring strip.

In accordance with other advantageous features of the invention:

- the mould is formed by photolithography;
- the mould includes several levels one above the other;
- steps a) and b) are repeated prior to step c) to form several levels one above the other.

BRIEF DESCRIPTION OF THE DRAWINGS

Other features and advantages will appear clearly from the following description, given by way of non-limiting illustration, with reference to the annexed drawings, in which.

DETAILED DESCRIPTION OF PREFERRED EMBODIMENTS

The invention relates to a mainspring such as for a timepiece barrel or striking mechanism. Evidently, other applications requiring a mainspring may also be envisaged, such as for example an automaton.

Figure 1:
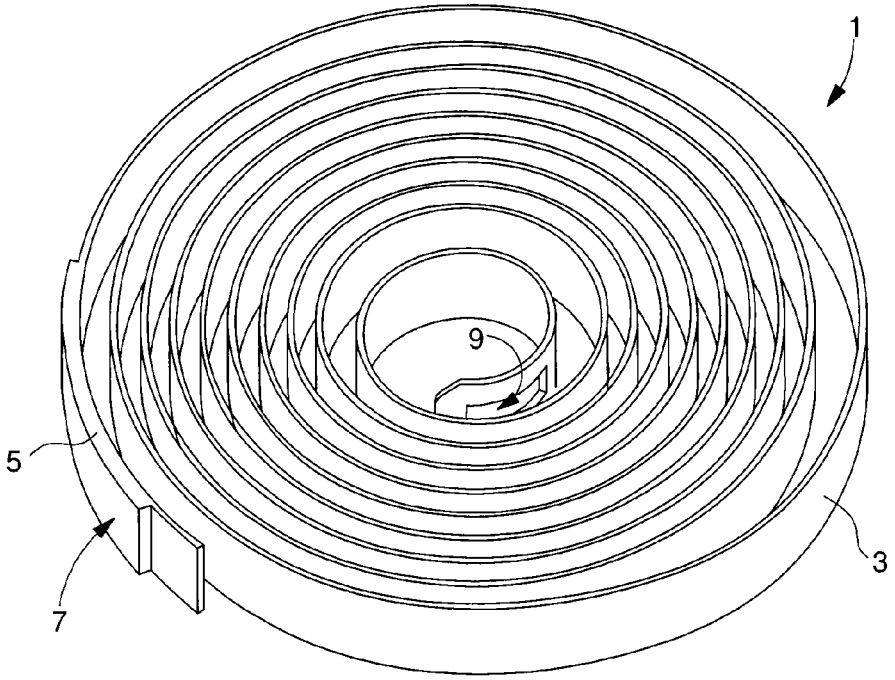
FIG. 1 is a diagram of a mainspring according to a first embodiment of the invention.

In a first embodiment illustrated in FIG. 1, mainspring 1 includes a metallic strip 3 wound on itself. Further, strip 3 includes an excess thickness 5 on one part of the outer coil forming a bridle 7 in one-piece with strip 3. As seen in FIG. 1, excess thickness 5 extends radially with a substantially uniform thickness towards the exterior of mainspring 1, i.e. the interior of the outer coil can still slide against the exterior of the remainder of strip 3. Further, excess thickness 5 is formed between the start of the outer coil and before the free end of the outer coil, i.e. the free end of the outer coil includes substantially the same section as the remainder of the non-thickened outer coil. It is thus understood that the problems caused by the small dimensions of bridle 7 are cancelled out by the one-piece construction. Further, bridle 7 is always perfectly positioned relative to strip 3 of mainspring 1.

In the example illustrated in FIG. 1, strip 3 of mainspring 1 also includes, on the inner coil thereof, an eyelet 9 integral with strip 3 and intended to cooperate, for example, with the hook of a core. This architecture, as will be explained below, allows for great precision as to the dimensions of the aperture of eyelet 9 and the positioning thereof on the inner coil of strip 3.

Figure 2:
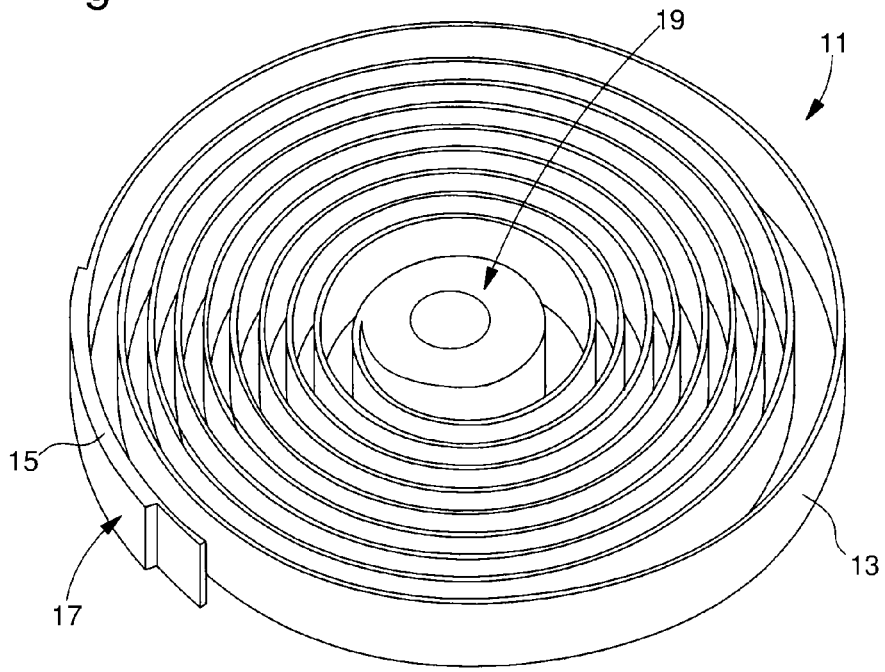
FIG. 2 is a diagram of a mainspring according to a second embodiment of the invention.

In a second embodiment illustrated in FIG. 2, mainspring 11 includes a metallic strip 13 wound on itself. Further, strip 13 includes an excess thickness 15 on one part of the outer coil forming a bridle 17 in one-piece with strip 13. As seen in FIG. 2, excess thickness 15 extends radially with a substantially uniform thickness towards the exterior of mainspring 11, i.e. the interior of the outer coil can still slide against the exterior of the remainder of strip 13. Further, excess thickness 15 is formed between the start of the outer coil and before the free end of the outer coil, i.e. the free end of the outer coil includes substantially the same section as the remainder of the non-thickened outer coil. It is thus understood that the problems caused by the small dimensions of bridle 17 are cancelled out by the one-piece construction. Further, bridle 17 is always perfectly positioned relative to strip 13 of mainspring 11.

In the example illustrated in FIG. 2, strip 13 of mainspring 11 also includes, on the inner coil thereof, a collet 19 integral with strip 13 and intended to cooperate, with a core or more generally a pivoting arbor. This architecture, as will be explained below, allows for great precision as to the dimensions of the aperture of collet 19 and the positioning thereof on the inner coil of strip 13.

FIGS. 3 to 6 show successive main steps of the method of manufacturing by electroforming a mainspring 1, 11 according to the invention. Preferably the method includes a first step consisting in taking a substrate 41 that includes an electrically conductive upper layer. This layer may be obtained by depositing an electrically conductive material on an insulating material or by the fact that the substrate is formed of an electrically conductive material.

The main electroforming steps consist in forming a mould and then filling the mould with the material, for example, by galvanoplasty. This type of electroforming is known by the abbreviation L.I.G.A. from the German terms "röntgen-Llthographie, Galvanoformung & Abformung". There are several types of L.I.G.A. processes depending upon whether the mould with several levels is formed between each galvanoplasty process or formed entirely and then only subsequently filled. For the explanation below, the technique presented consists in forming each level, i.e. forming one level of the mould and filling it before passing to the next level. Of course, any type of electroforming process capable of forming a one-piece mainspring having at least one level may be envisaged, whether or not it is of the L.I.G.A. type.

Figure 3:
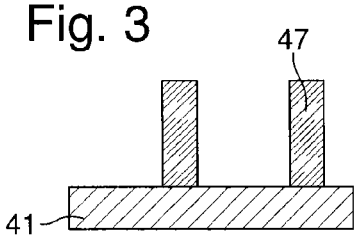
FIGS. 3 to 6 are diagrams of successive steps of a method for manufacturing a mainspring according to the invention.
Figure 4:
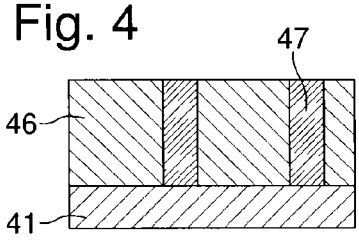

As illustrated in FIGS. 3 and 4, in a first phase, the first level 47 of the mould 42 is formed of resin by means, for example, of photolithography as illustrated in FIG. 3. At least one cavity is formed whose shape matches the pattern of the future mainspring 1, 11, i.e. with the integrated bridle 7, 17 and possibly collet 19. The first level is then filled by electroplating a metallic material 46. Of course, in the case of the second embodiment, a single level may be sufficient to form the future mainspring 11 with the integrated bridle 17 and possible collet 19.

Figure 5:
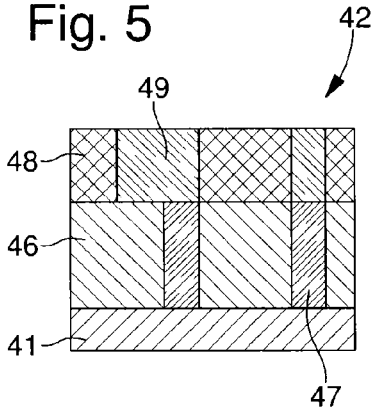

In the case of the first embodiment, if several levels are required to form, in particular, an eyelet 9, as illustrated in FIG. 5 in a similar manner to the first phase, in a second and a third phase, a second and third level are formed, for example also by means of photolithography of a resin.

In a second phase, at least one recess is formed whose shape corresponds to a second pattern, i.e. with the addition of material on the future hollow of eyelet 9 and communicating with said at least one cavity of first level 47. The second level 49 is then filled by electroplating a metallic material 48.

Finally, in a similar manner, in the third phase, at least a second cavity is formed whose shape corresponds to that, for example, of the first pattern of the first level, i.e. strip 3 with its integrated bridle 7 and communicating with said at least one cavity of the first level and the recess of the second level. The third level is then filled by electroplating a metallic material 50.

Figure 6:
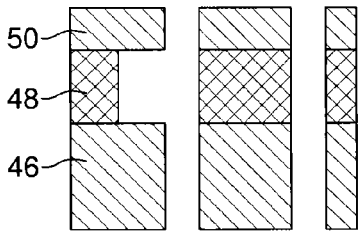

All that remains is to release the mainspring 1, 11 on the level or levels thereby formed from substrate 41 and resins 47, 49, as illustrated in FIG. 6, so as to mount mainspring 1, 11 for example in a timepiece.

Preferably according to the invention, the metal material 46, 48, 50 deposited is a nickel and phosphorus alloy, typically with substantially 12% phosphorus (NiP12). Indeed, it was found satisfactory to use this type of alloy for manufacturing a mainspring because it has a modulus of elasticity of around 90 GPa and an elastic limit of around 1700 MPa.

It is thus understood that there are no longer separate steps for manufacturing and securing bridle 7, 17 of mainspring 1, 11. Indeed, bridle 7, 17 is directly formed at the same time as strip 3, 13 of mainspring 1, 11. Depending upon the required embodiments, this advantage is also valid for any collets 19 or eyelet 9.

It is thus immediately apparent that reject rates are much more satisfactory without poor quality output of bridles and poor quality in the attachment of the bridle to the mainspring strip. Finally, bridle 7, 17, eyelet 9 and/or collet 19 are structurally always perfectly positioned relative to strip 3, 13.

Of course, this invention is not limited to the illustrated example but is capable of various variants and modifications that will appear to those skilled in the art. In particular, the eyelet 9-hook assembly between mainspring 1 and the barrel core may be reversed. It is thus clear that mainspring 1 may be provided with a hook in place of eyelet 9.

Figure 7:
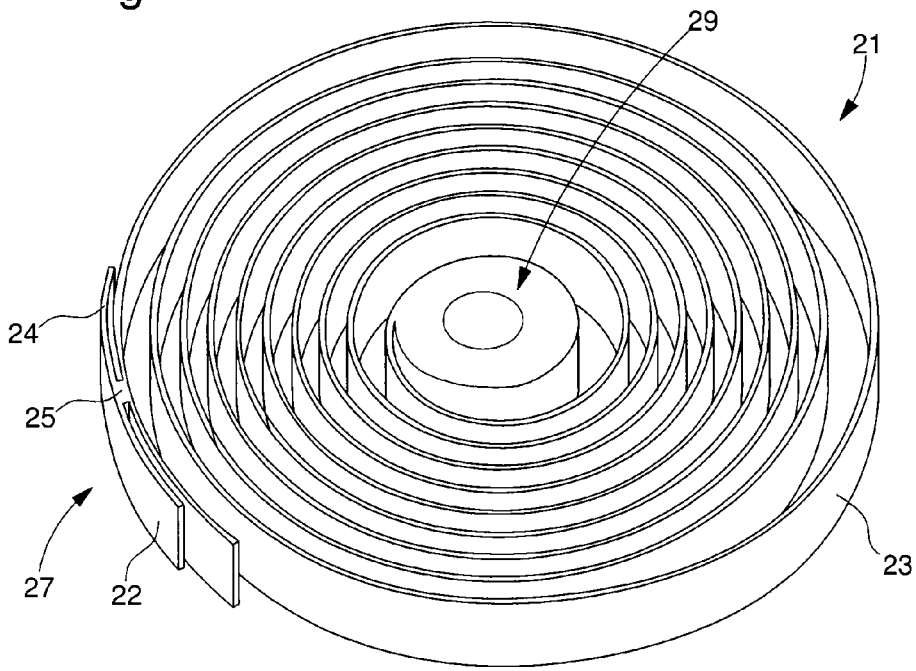
FIG. 7 is a diagram of a mainspring according to a third embodiment of the invention.

Further, upon reading the manufacturing method, it is understood that it is no longer difficult to manufacture a mainspring like that 21 illustrated in FIG. 7. Thus, in a third embodiment illustrated in FIG. 7, mainspring 21 includes a metal spring 23 wound on itself. Strip 23 includes an excess thickness 25 over one part of the outer coil forming a one-piece base with strip 23. Further, strip 23 of mainspring 21 also includes, on the inner coil thereof, a collet 29 integral with the strip 23 and intended to cooperate, for example, with a core or more generally a pivoting arbor.

As seen in FIG. 7, excess thickness 25 extends radially with a substantially uniform thickness towards the exterior of mainspring 21, i.e. the interior of the outer coil can still slide against the exterior of the remainder of strip 23. The excess thickness 25 is formed between the start of the outer coil and before the free end of the outer coil, i.e. the free end of the outer coil has substantially the same section as the remainder of the non-thickened outer coil.

Further, excess thickness 25 forms a base for at least a second strip 22, 24 forming a bridle 27 in one-piece with strip 23. In the example of FIG. 7, said at least one second strip 22, 24 at least partially follows the exterior of the outer coil of mainspring 21. Thus, advantageously according to the invention, said at least one second strip 22, 24 may, for example, run along half of the outer coil. Said at least one second strip 22, 24 may also include several second strips 22, 24 extending along a section and/or a direction and/or a way that may or may not be different relative to excess thickness 25 forming its base. In the example of FIG. 7, it can be seen, for example, that the excess thickness 25 forming the base includes two second strips 22, 24 of identical thickness and height but of different lengths extending in the same direction but in opposite ways.

It is also understood that several excess thicknesses 5, 15, 25 may be formed on the same strip 3, 13, 23, without rendering mainspring 1, 11, 21 any more difficult to manufacture.

Further, excess thickness 5, 15, 25 should not be limited to the thickness of strip 3, 13, 23, it may also concern the thickness and/or the height. Thus, by way of example, the excess thickness could be over a greater height so as to selectively butt between the drum and the cover of the barrel.

Finally, more generally, the various elements 5, 7, 9, 15, 17, 19, 22, 24, 25, 27, 29 of each mainspring 1, 11, 21 may be combined with each other.

The invention claimed is:

1. A mainspring comprising:

a metallic strip wound on itself and including an outer coil, the outer coil including an excess thickness in one-piece with the strip between a start of the outer coil and before a free end of the outer coil which forms a base extending radially with a substantially uniform thickness towards an exterior of the mainspring; and at least one second strip forming a bridle in one-piece with the strip and that extends from the base and at least partially runs in a substantially parallel manner along an exterior of a non-thickened portion of the outer coil of the mainspring.

2. The mainspring according to claim 1, wherein the at least one second strip includes two strips extending in a same direction from the excess thickness but in opposite senses.

3. The mainspring according to claim 1, wherein the at least one second strip includes a constant thickness and/or a constant height.

4. The mainspring according to claim 1, wherein the excess thickness includes a constant thickness and/or a constant height.

5. The mainspring according to claim 1, wherein the mainspring includes an inner coil with an eyelet integral with the strip.

6. The mainspring according to claim 1, wherein the mainspring includes an inner coil with a hook integral with the strip.

7. The mainspring according to claim 1, wherein the mainspring includes an inner coil with a collet integral with the strip.

8. The mainspring according to claim 1, wherein the mainspring is formed from a nickel and phosphorus alloy base.

9. A timepiece comprising a mainspring according to claim 1.

10. The mainspring according to claim 1, wherein at least one second strip runs spaced apart from the exterior of the non-thickened portion of the outer coil of the mainspring.

* * * * *